US006368164B1

(12) United States Patent
Nakamura

(10) Patent No.: US 6,368,164 B1
(45) Date of Patent: Apr. 9, 2002

(54) CONNECTOR WITH A RETAINER

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/670,872

(22) Filed: Sep. 27, 2000

(30) Foreign Application Priority Data

Oct. 21, 1999 (JP) ..... 11-299849

(51) Int. Cl.[7] ..... H01R 13/434

(52) U.S. Cl. ..... 439/752; 439/489

(58) Field of Search ..... 439/352, 359, 439/353, 370, 489

(56) References Cited

U.S. PATENT DOCUMENTS

| | | | | |
|---|---|---|---|---|
| 5,037,336 A | | 8/1991 | Betsui | 439/752 |
| 5,203,722 A | | 4/1993 | Kinoshita | |
| 5,429,527 A | * | 7/1995 | Nozaki et al. | 439/489 |
| 5,928,038 A | * | 7/1999 | Berg et al. | 439/752 |

FOREIGN PATENT DOCUMENTS

| | | |
|---|---|---|
| EP | 0 851 535 | 7/1998 |

* cited by examiner

*Primary Examiner*—Paula Bradley
*Assistant Examiner*—Ann McCamey
(74) *Attorney, Agent, or Firm*—Anthony J. Casella; Gerald E. Hespos

(57) ABSTRACT

A connector is provided to detect partial mounting of a retainer. A female housing 11 of the connector 10 is provided with an escaping portion 20, which is aligned with a lock arm 14 in its deforming direction only when a retainer 15 is mounted in a full locking position. By being aligned with the escaping portion 20, the lock arm 14 is enabled to undergo an elastic deformation to permit the connection of the female housing 11 with a male housing 12. On the other hand, if the retainer 15 is partly mounted without reaching the full locking position, the escaping portion 20 is not aligned with the lock arm 14, which refrains the lock arm 14 from being sufficiently elastically deformed. As a result, the female and males housings 11, 12 cannot be connected, which enables detection of partial mounting of the retainer 15. Thus, partial mounting of the retainer 15 can be securely detected by setting a degree of deformation of the lock arm 14 larger than a clearance between the housings 11 and 12.

8 Claims, 9 Drawing Sheets

CONNECTOR WITH A RETAINER

SUMMARY OF THE INVENTION

1. Field of the Invention

The present invention relates to a connector provided with a retainer.

2. Description of the Related Art

A prior art connector with a retainer is disclosed in Japanese Patent Publication No. 2627357 is identified generally by the numeral 1 in FIGS. 12 and 13 of this application. The prior art connector 1 has a housing 2 formed with cavities for accommodating terminal fittings, and a retainer 3 is mountable in the housing 2 in a direction that intersects the inserting direction of the terminal fittings. The retainer 3 can be pushed to a full locking position in the housing 2 to lock the terminal fittings and to prevent them from coming out. Thereafter, the housing 2 is connected with a mating housing 4 by inserting the housing 2 into a receptacle 5 of the mating housing 4. If the retainer 3 has not been pushed to its full locking position, it projects from the housing 2, and interferes with the opening edge of the receptacle 5 while the housings 2 and 4 are being connected (see FIG. 12). Partial mounting of the retainer 3 can be detected since the housing 2 cannot be fitted completely into the receptacle 5.

A connection clearance may exist between the housing 2 and the receptacle 5 to facilitate the connection or due to a dimensional error in the connector. Accordingly, if a projecting distance of the retainer 3 from the housing 2 is small, the housings 2 and 4 can be connected with each other due to the presence of this clearance even if the retainer 3 is mounted only partially, as shown in FIG. 13. Therefore, partial mounting of the retainer 3 may not be detected with a sufficient precision.

The present invention was developed in view of the above problem, and an object thereof is to provide a connector, which can securely detect partial mounting of a retainer.

SUMMARY OF THE INVENTION

The subject invention is directed to a connector with a housing that has at least one cavity formed therein for at least partly accommodating a corresponding number of terminal fittings therein. The housing can be fit at least partly into a receptacle of a mating housing. A retainer can be inserted into the housing and is configured to lock the terminal fittings in the cavities when the retainer is mounted in a full locking position. According to a preferred embodiment, the retainer is inserted into the housing along a direction that intersects the inserting direction of the terminal fittings into the cavities. A lock arm is provided on the housing and can be engaged with the mating housing to prevent the two housings from being disengaged from each other. An escape portion is provided in a position on the retainer facing or near the lock arm in a deforming direction for permitting an elastic deformation of the lock arm only when the retainer substantially reaches the full locking position.

The escaping portion is aligned with the lock arm in the deforming direction when the retainer is in the full mount position. Thus, the lock arm can enter the escaping portion and undergo a specified degree of elastic deformation. On the other hand, if the retainer is mounted only partly and has not reached the full locking position, the escaping portion is not aligned with the lock arm. Consequently, insertion of the housing into the receptacle of the mating housing is hindered, and the lock arm is not permitted to undergo a sufficient degree of elastic deformation. Accordingly, the elastically deformable lock arm functions as a detecting means that detects a partial mounting of the retainer based on whether the housings can be connected with each other.

In other words, a large difference between the degree of deformation of the lock arm when the connection is permitted and that when the connection is not permitted can be provided if the depth of the escaping portion is set sufficiently large. Thus, a reduction of the detecting function caused by a clearance between the housing and the receptacle, as seen in the prior art, can be avoided and partial mounting of the retainer can be detected securely.

The retainer preferably comprises a main body that can be inserted into an insertion opening in a side surface of the housing to lock the terminal fittings and to prevent the terminal fittings from coming out of the cavities. The retainer also comprises a detecting piece located outside the housing and facing the lock arm in the deforming direction.

The retainer also may comprise a holding piece at substantially the opposite side of the main body from the detecting piece and located outside the housing. Most preferably, the detecting piece and/or the holding piece are provided with a locking portion for engaging the housing to prevent the entire retainer from coming out of the housing.

The detecting piece is located outside the housing and faces the lock arm in the deforming direction. Additionally, the locking portion of the detecting piece securely holds the retainer in the full locking position so that the escaping portion securely faces the lock arm in the deforming direction. Thus, partial mounting of the retainer can be detected.

The retainer further preferably comprises a holding piece at the side of the main body opposite from the detecting piece and located outside the housing. The holding piece also has a locking portion for engaging the housing. Since the retainer is mounted while holding the housing between the detecting piece and the holding piece, the connector can stably hold the retainer.

The retainer preferably is movable with respect to the housing between a partial locking position and the full locking position. Insertion and withdrawal of the terminal fittings into and from the cavities is permitted when the retainer is in the partial locking position. The retainer is prevented from coming out of the housing while held in the partial locking position. Thus an assembly of the housing and the partially mounted retainer can be transported easily to a location where the terminal fittings are inserted into the housing. Therefore, the connector has an improved assembling operability.

The escaping portion preferably comprises a slanted portion that is slanted towards the housing with an angle of inclination substantially corresponding to a deformation angle of the deformed lock arm.

Most preferably, one of the lock arm and the escaping portion comprises a detecting projection and the other of the lock arm and the escaping portion comprises a mating detecting recess. The detecting projection can be inserted into the detecting recess when the retainer is in the full lock position so as to allow elastic deflection of the lock arm.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
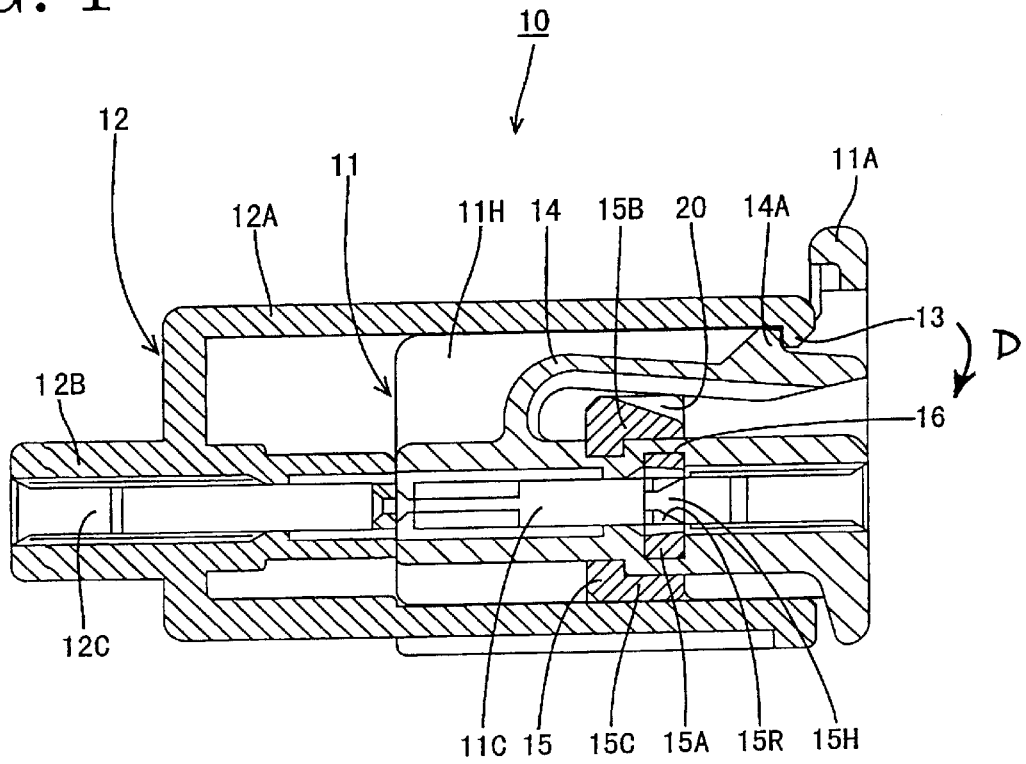
FIG. 1 is a vertical section of a connector according to one embodiment of the invention.
Figure 2:
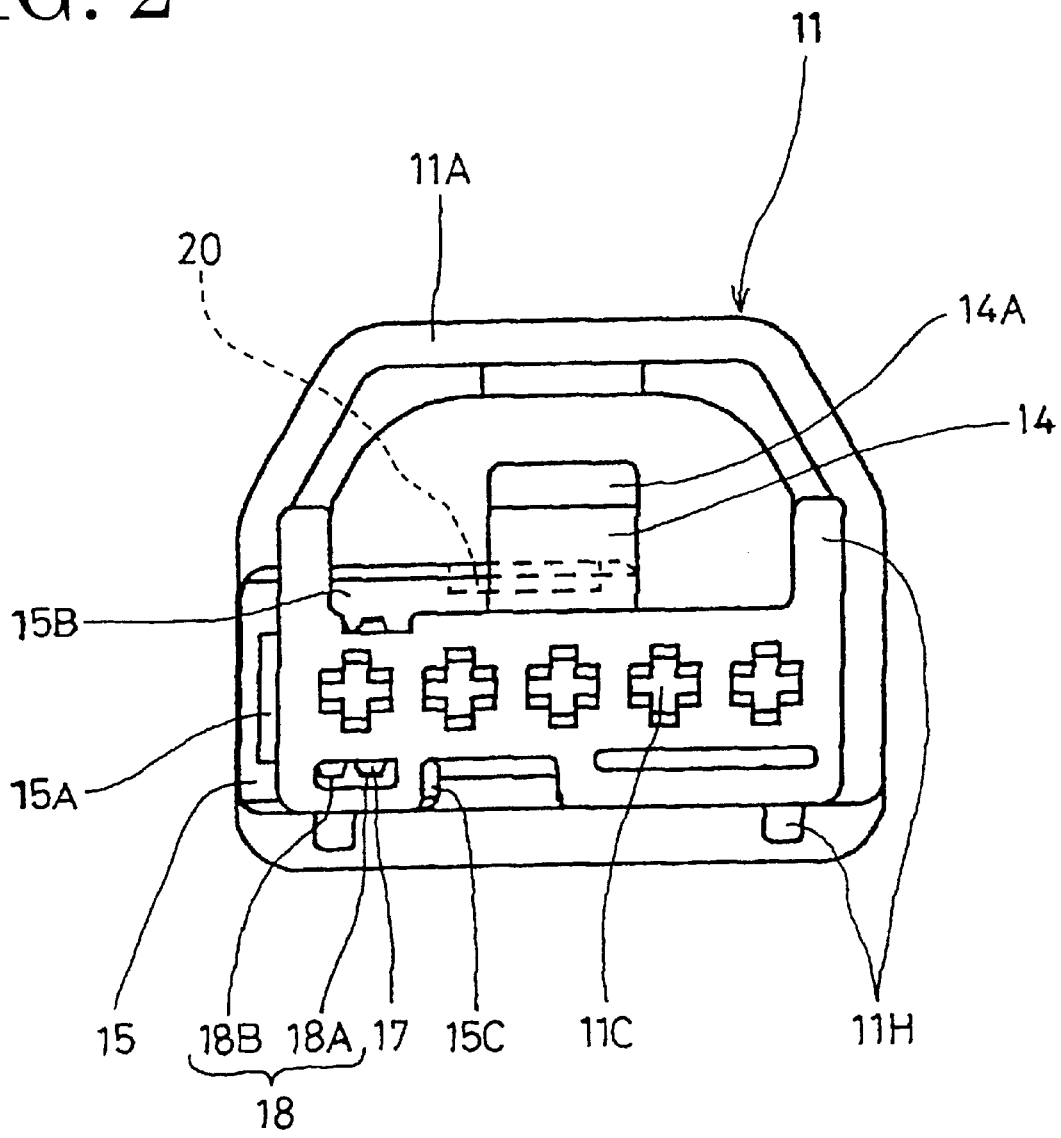
FIG. 2 is a front view of a female housing when a retainer is in a partial locking position.
Figure 3:
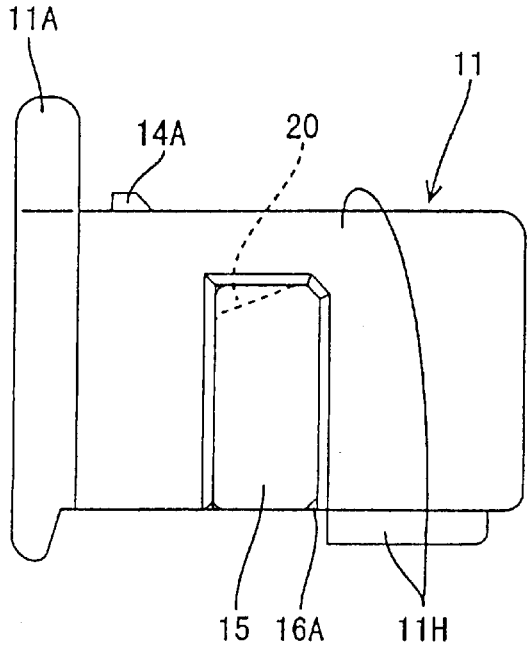
FIG. 3 is a side view of the female housing when the retainer is in the partial locking position.
Figure 4:
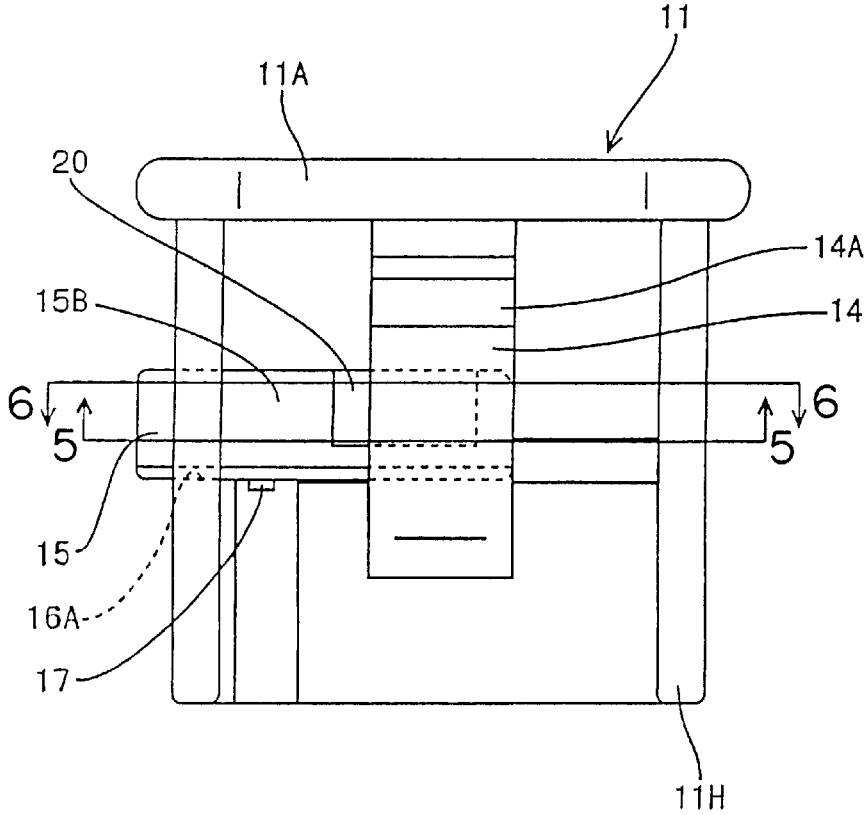
FIG. 4 is a plan view of the female housing when the retainer is in the partial locking position.
Figure 5:
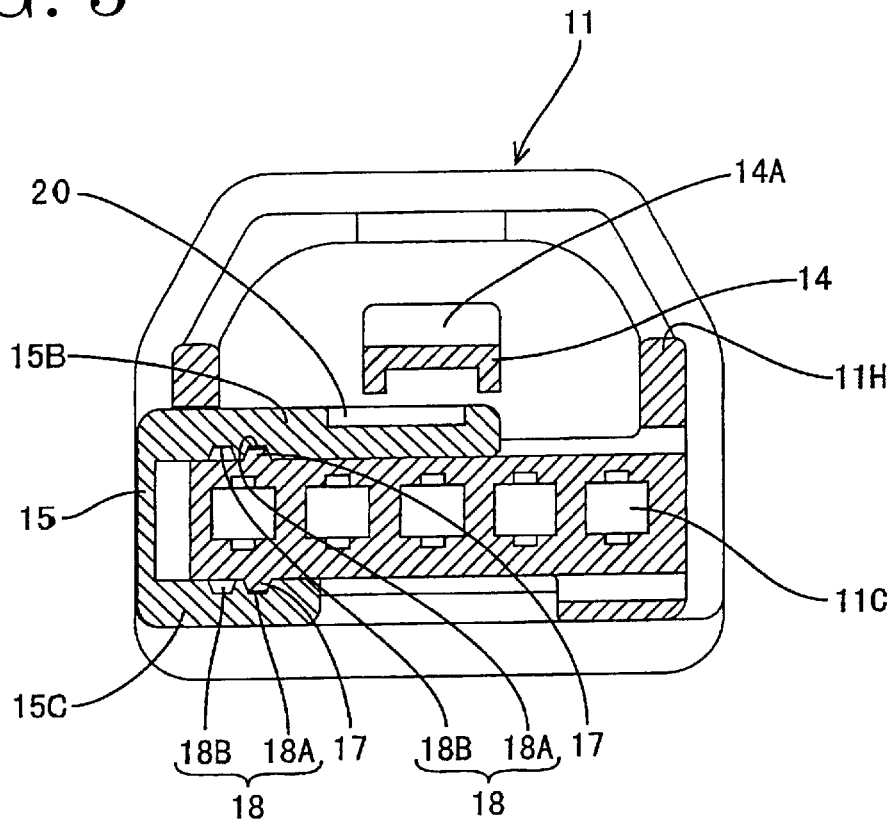
FIG. 5 is a section along 5—5 of FIG. 4.

A connector in accordance with the subject invention is identified generally by the numeral 10 in FIGS. 1 to 10. The connector 10 comprises a male housing 12 and a female housing 11, as shown in FIG. 1.

The male housing 12 has a main body 12B made e.g. of a synthetic resin and having a shape of a substantially rectangular column. Cavities 12C penetrate through the main body 12B in a longitudinal or forward and backward direction for at least partly accommodating unillustrated terminal fittings. The male housing 12 also has a substantially tubular receptacle 12A, which at least partly surrounds a front half of the main body 12B. A housing lock 13 projects from the inner side of an opening edge of the receptacle 12A. The housing lock 13 can be engaged with a lock arm 14 of the female housing 11 as described later.

The female housing 11 is made e.g. of a synthetic resin and has a shape of a substantially rectangular column. A plurality of cavities 11C penetrate substantially through the female housing 11 in longitudinal or forward and backward direction for at least partly accommodating unillustrated female terminal fittings. A lock arm 14 cantilevers backward in a position corresponding to the housing lock 13, and preferably is disposed substantially in the middle of the upper surface of the female housing 11 with respect to widthwise direction. The lock arm 14 is elastically deformable upward and downward or toward and away from the female housing 11. A locking projection 14A is formed on the upper surface of the rear end the lock arm 14. The lock arm 14 moves under or cooperates with the housing lock 13. Additionally, the rear end of the lock arm 14 is deformed elastically in a downward deformation direction D, while the housings 11 and 12 are being connected. When the housings 11 and 12 are connected properly, the lock arm 14 passes the housing lock 13 and is restored elastically substantially to its original shape. In this way, the locking projection 14A engages the housing lock 13 to lock the housings 11 and 12 into each other. The terminal fittings in the housings 11 and 12 are connected electrically in this state.

An operable portion 11A is formed at the rear end of the female housing 11 and projects radially over substantially the entire circumference of the female housing 11. The upper half of the operable portion 11 is substantially arch-shaped (see FIG. 2). An operator can insert and withdraw the female housing 11 into and from the male housing 12 while holding or manipulating the operable portion 11A.

Guiding projections 11H project from the upper and lower or lateral surfaces of the female housing 11, and unillustrated guide grooves corresponding thereto are formed in the receptacle 12A of the male housing 12. The housings 11 and 12 can be fit stably and substantially without shaking by inserting the female housing 11 into the male housing 12 while engaging the guiding projections 11H with the guide grooves.

The female housing 11 is formed with a retainer-accommodating portion 16, which extends in a direction that intersects an inserting direction of unillustrated terminal fittings. One end of the retainer-accommodating portion 16 preferably is open substantially in the middle of one side surface of the female housing 11, thereby forming an insertion opening 16A (see FIG. 3). The retainer-accommodating portion 16 communicates with the respective cavities 11C. Further, locking projections 17 project substantially symmetrically in positions on the upper and lower surfaces of the female housing 11 near the retainer-accommodating portion 16A (see FIG. 5).

A retainer 15 is formed integrally or unitarily e.g. of a synthetic resin and comprises a main body 15A preferably in the form of a thick plate. A detecting piece 15B and a holding piece 15C are provided substantially above and below the main body 15A while defining clearances therebetween (see FIG. 6).

Figure 6:
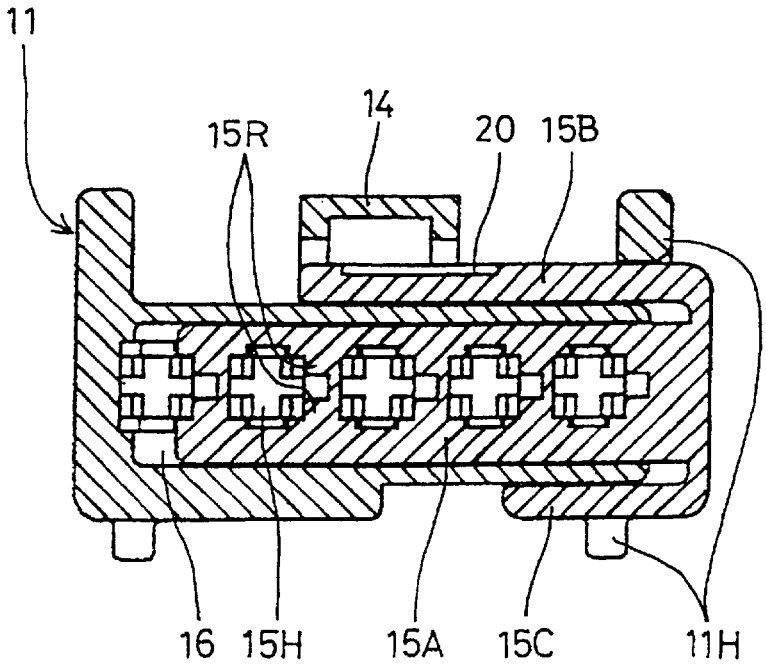
FIG. 6 is a section along 6—6 of FIG. 4.

The main body 15A is formed for at least partial insertion into the retainer-accommodating portion 16, and includes communication holes 15H that are aligned with and communicate with the cavities 11C (see FIGS. 1 and 6). Each communication hole 15H of the retainer 15 is formed with locking portions 15R. The locking portions 15R engage the female terminal fittings when the main body 15A is in a full locking position in the retainer-accommodating portion 16 of the female housing 11 to lock the female terminal fittings in the cavities 11C.

The detecting piece 15B is connected with one end of the main body 15A for elastic deformation and extends substantially along the main body 15A. The detecting piece 15B is located substantially in close contact with the upper surface of the female housing 11 and has a length such that its leading end crosses below or reaches the lock arm 14 when the retainer 15 is inserted to the proper mount position in the retainer accommodating portion 16 (see FIG. 9).

The elastically deformable holding piece 15C is provided at the side of the main body 15A opposite the detecting piece 15B, and cantilevers along the main body 15A from the end of the main body 15A with the detecting piece 15B. The holding piece 15C is substantially in close contact with the lower surface of the female housing 11 when the retainer 15 is inserted into the retainer-accommodating portion 16. In this embodiment, the holding piece 15C is shorter than the detecting piece 15B.

Locking recesses 18 are provided substantially symmetrically on the inner surfaces of the detecting piece 15B and the holding piece 15C near the sides that are connected with the main body 15A. The locking recesses 18 include partial locking recesses 18A and full locking recesses 18B, which can be engaged selectively with the locking projections 17 (see FIGS. 5 and 9). The retainer 15 is held in a partial lock position with respect to the female housing 11 when the partial locking recesses 18A and the locking projections 17 are engaged, thereby permitting insertion and withdrawal of the terminal fittings into and from the cavities 11C (see FIG. 5). The full locking recesses 18B and the locking projections 17 engage when the retainer 15 is inserted further into the retainer-accommodating portion 16. Thus the retainer 15 is held in a full locking position where it engages the female terminal fittings (not shown) to double-lock the terminal fittings in the cavities 11C (see FIG. 9).

Figure 7:
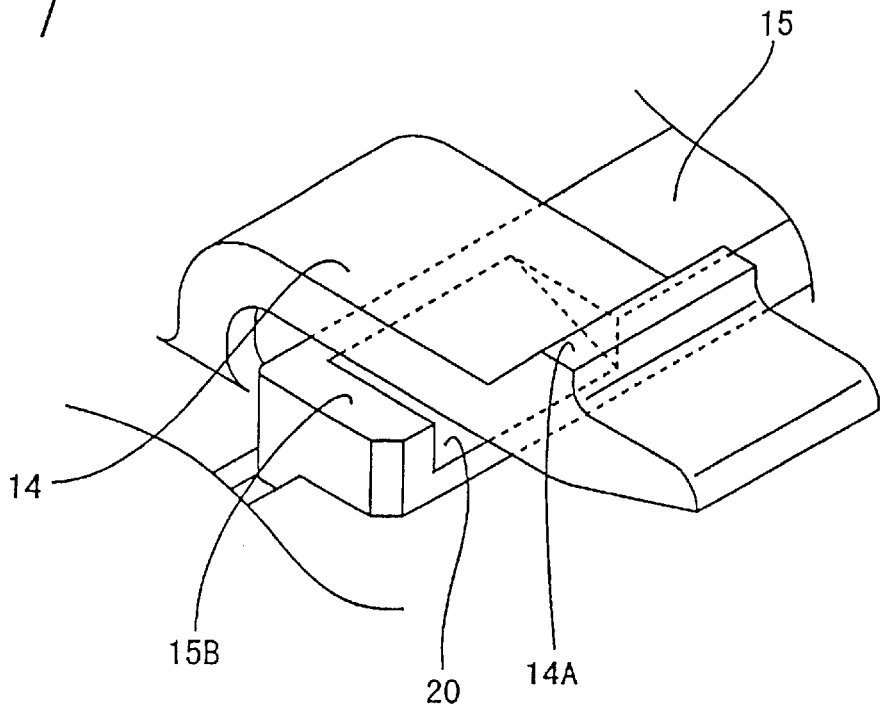
FIG. 7 is an enlarged perspective view of a lock arm and an escaping portion.
Figure 8:
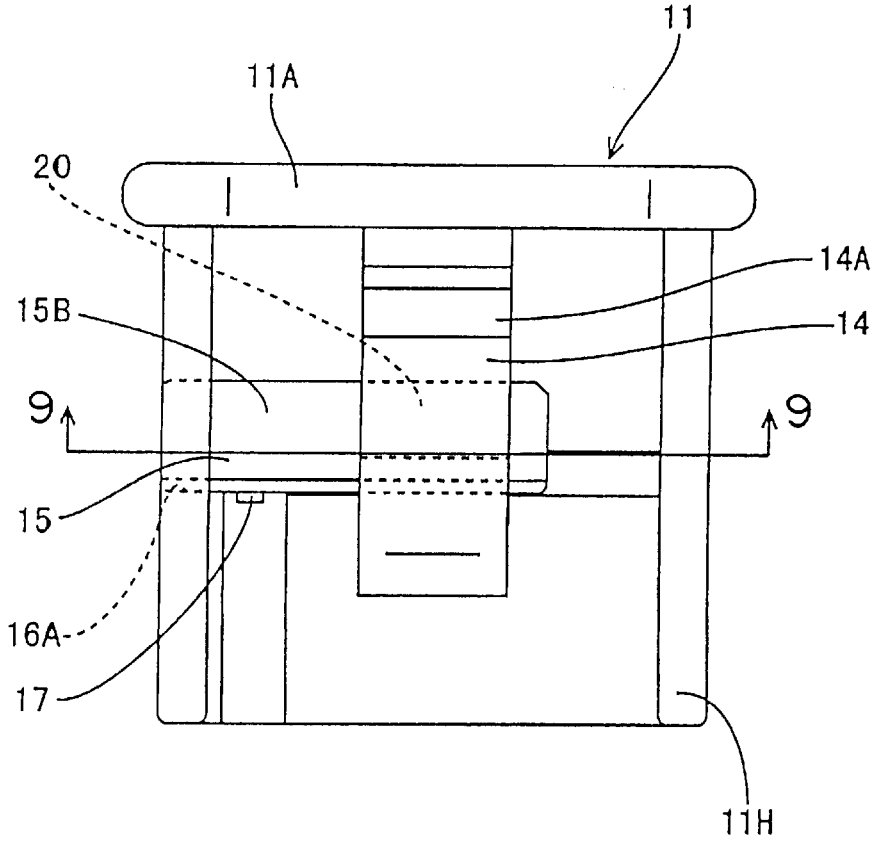
FIG. 8 is a plan view of the female housing when the retainer is in a full locking position.
Figure 9:
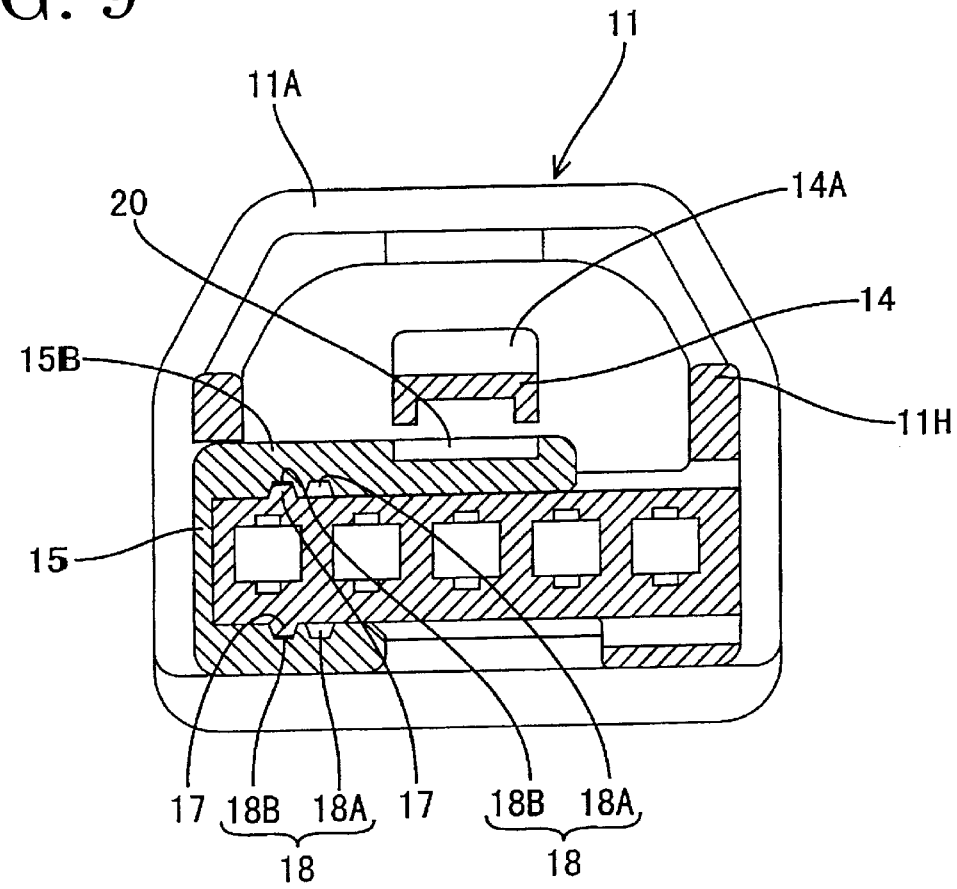
FIG. 9 is a section along 9—9 of FIG. 8.
Figure 10:
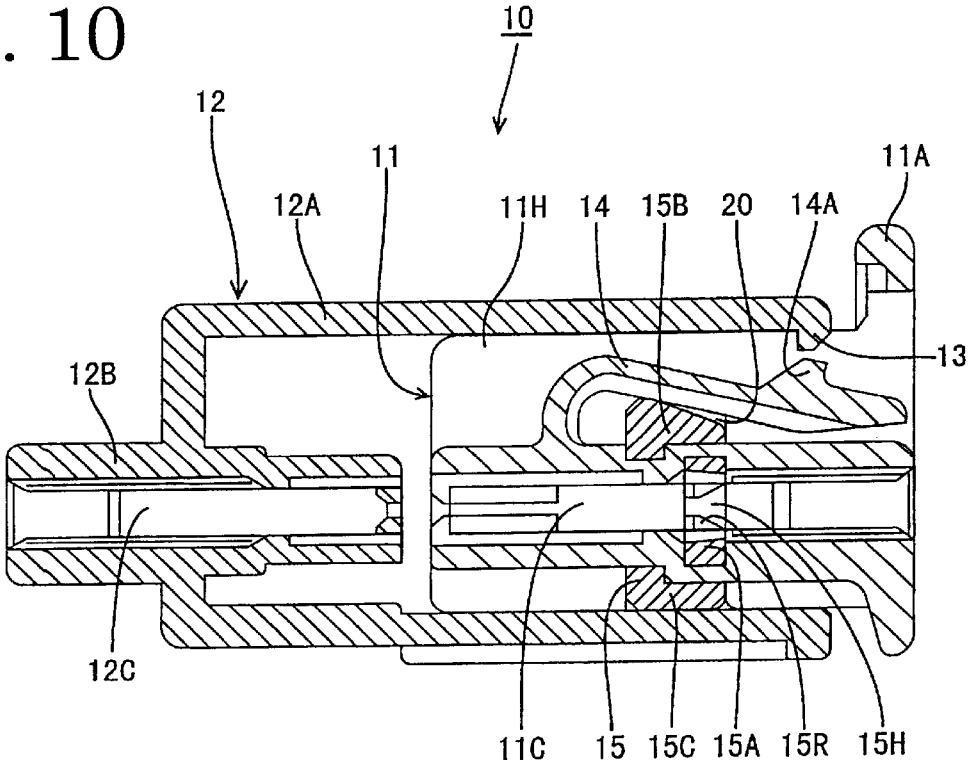
FIG. 10 is a vertical section of the connector while male and female housings are being connected when the retainer is in the full locking position.
Figure 11:
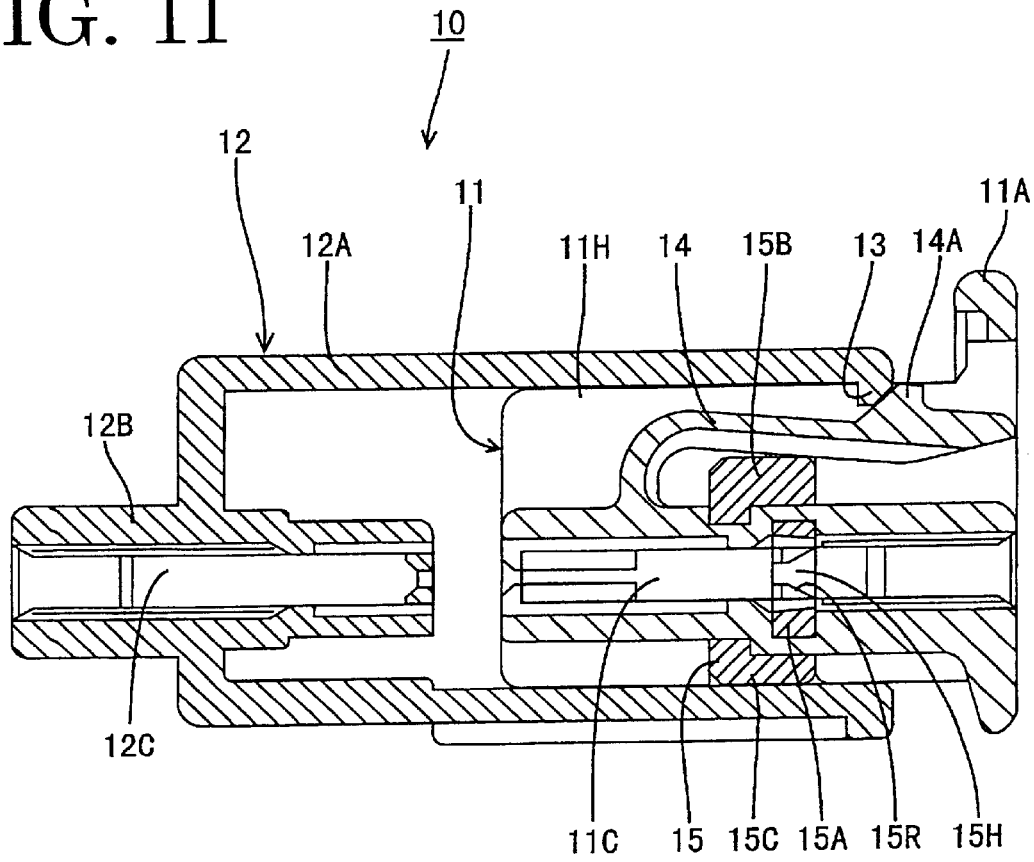
FIG. 11 is a vertical section of the connector while the male and female housings are being connected when the retainer is partly mounted.
Figure 12:
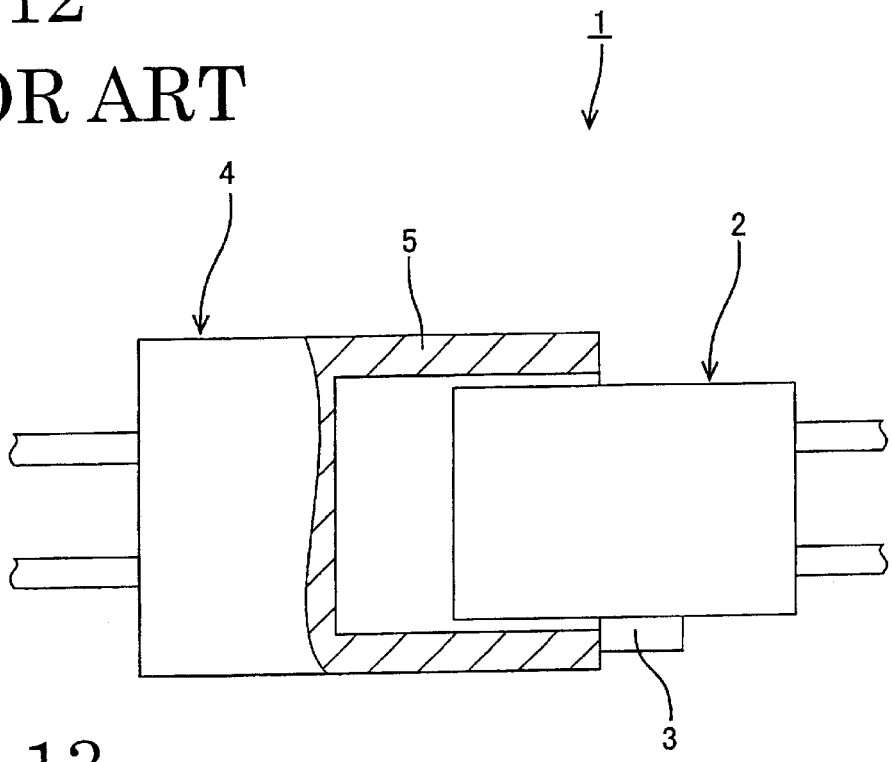
FIG. 12 PRIOR ART
FIG. 12 is a vertical section of a prior art connector while male and female housings are being connected when a retainer is partly mounted.
Figure 13:
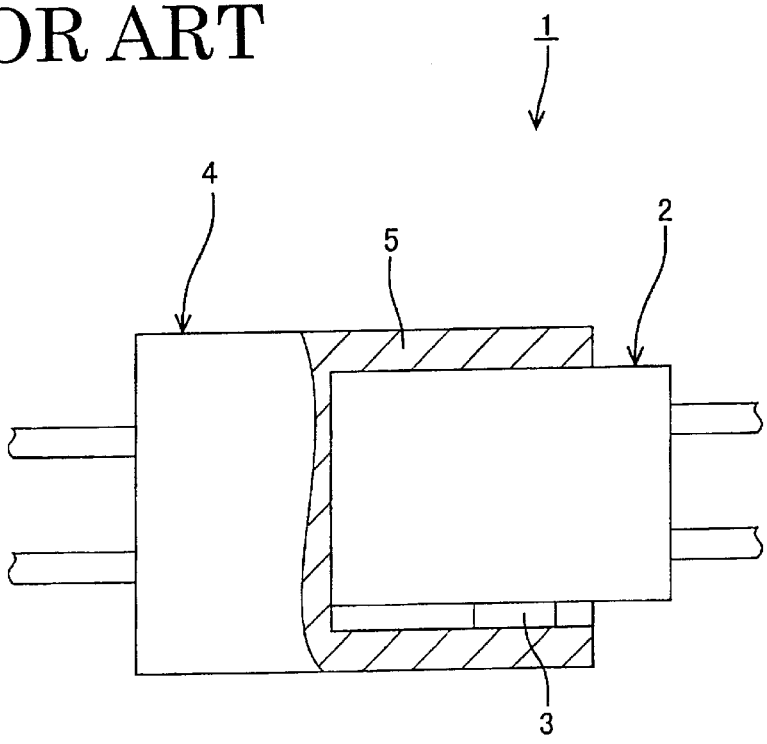
FIG. 13 PRIOR ART
FIG. 13 is a vertical section of the prior art connector whose male and female housings are connected with a retainer left partly mounted.

An escaping portion 20 is formed in the upper surface of the detecting piece 15B of the retainer 15, as shown in FIG. 7, for permitting an elastic deformation of the lock arm 14. The escaping portion 20 is located below the lock arm 14 when the retainer 15 is in the full locking position (see FIGS. 8 and 9). The width of the escaping portion 20 preferably is set substantially equal to or slightly larger than the width of the lock arm 14. The bottom surface of the escaping portion 20 is slanted gradually downward from its front end to its rear end such that an angle of inclination substantially corresponds to an angle or orientation of the deformed lock arm 14 when the locking projection 14A passes the housing lock 13 (see FIG. 10). The lock arm 14 is not aligned with the escaping portion 20 before the retainer 15 reaches the full locking position, and the upper surface of the detecting piece 15B interferes with the lock arm 14. Thus, the lock arm 14 is not permitted to deform to a degree sufficient for the locking projection 14A to pass the housing lock 13 (see FIG. 11).

The main body 15A of the retainer 15 can be inserted into the retainer-accommodating portion 16 through the retainer-accommodating portion opening 16A of the female housing 11. At this time, the retainer 15 is guided into the retainer-accommodating portion 16 while holding the female housing 11 by the detecting piece 15B and the holding piece 15C. When the partial locking recesses 18A of the detecting piece 15B and the holding piece 15C are engaged with the locking projections 17 of the female housing 11, the retainer 15 is held in its partial locking position in the female housing 11 (see FIG. 5). The connector 10 is transferred to a location for terminal insertion with the retainer 15 and the female housing 11 integrally assembled. When the retainer 15 is in the partial locking position, the terminal fittings can be inserted into the cavities 11C since the locking portions 15R in the respective communication holes 15H of the retainer 15 do not project into the cavities 11C.

The retainer 15 can be pushed beyond the partial locking position, such that the locking projections 17 release from the partial locking recesses 18A of the detecting piece 15B and the holding piece 15C due to deformations of the detecting piece 15B and the holding piece 15C in opening directions. The locking projections 17 then engage with the full locking recesses 18B. As a result the retainer 15 is held in the full locking position (see FIG. 9). In this position, the locking portions 15R of the retainer 15 project into the cavities 11C to engage parts of the female terminal fittings (not shown) in the cavities 11C, thereby locking them.

The female housing 11 then is inserted at least partly inserted into the receptacle 12A of the male housing 12. Then, the locking projection 14A of the lock arm 14 contacts the housing lock 13, and the lock arm 14 is deformed elastically downward and away from the housing lock 13 to pass under (or over) the housing lock 13. If the retainer 15 is inserted properly to the full locking position, the escaping portion 20 is aligned substantially right below the lock arm 14 in a deforming direction of the lock arm 14. Accordingly, the lock arm 14 is permitted by the escaping portion 20 to undergo a proper elastic deformation (see FIG. 10). As a result, the locking projection 14A can pass under the housing lock 13. After this, the locking projection 14A and the housing lock 13 are engaged or interact with each other or cooperate to hold the male and female housings 11 and 12 properly connected as shown in FIG. 1.

The retainer 15 may be left partly mounted without reaching its full locking position, for example, because the retainer 15 cannot be moved to the full locking position due to improperly inserted terminal fittings or because the retainer 15 was not moved completely to the full locking position even though the terminal fittings were inserted properly. In this instance, the escaping portion 20 is not aligned with the lock arm 14. Accordingly, the detecting piece 15B interferes with the lock arm 14, and the lock arm 14 cannot be deformed elastically to a degree that will permit the locking projection 14A to pass the housing lock 13. As a result, the female housing 11 cannot be inserted into the receptacle 12A of the male housing 12 (see FIG. 11). Thus, an operator knows that the retainer is mounted only partly because the housings 11 and 12 cannot be connected with each other.

In other words, in this embodiment, partial mounting of the retainer 15 is detected based on whether the housings 11 and 12 can be connected with each other. In the prior art, as described above, a partly mounted retainer projects from the housing and interferes the mating housing. The projecting amount of the retainer acts as a detecting means for detecting an inability to connect the housings. Thus, if the projecting amount is small, it might be offset by a connection clearance between the housings. As a result, the partial mounting of the retainer may not be detected.

However, in this embodiment, the elastically deformable lock arm 14 is used as a detecting means, and a degree of elastic deformation of the lock arm 14 can be set independently of the connection clearance between the housings, e.g. by adequately setting the projecting amount of the locking projection 14A. Thus, the position of the lock arm 14 where the connection of the male and female housings 11 and 12 is permitted and that of the lock arm 14 where it is not permitted can be spaced sufficiently apart by securing a sufficient depth of the escaping portion 20.

Therefore, according to the connector 10 of this embodiment, a reduction of the detecting function due to a mounting error or a manufacturing error can be avoided and partial mounting of the retainer can be detected securely.

The present invention is not limited to the above embodiment. For example, following embodiments are also embraced by the technical scope of the invention as defined in the claims. Besides these embodiments, various changes can be made without departing from the scope and spirit of the invention as defined in the claims.

In the foregoing embodiment, the elastic deformation of the lock arm 14 is permitted by causing the entire lock arm 14 to enter the escaping portion 20 formed in the retainer 15. Alternatively, a projection may be formed on the lock arm, and an escaping portion in the form of a recess adapted to the projection of the lock arm may be so formed as to fit the projection only when the retainer is in the full locking position. In this way, the elastic deformation of the lock arm may be permitted.

Although the female terminal fittings are accommodated in the housing 11 in the foregoing embodiment, male terminal fittings may be accommodated.

What is claimed is:

1. A connector, comprising:

a housing with a plurality of cavities for accommodating a plurality of terminal fittings, an insertion opening being formed in a side surface of the housing and communicating with said cavities, said housing being at least partly fittable in a receptacle of a mating housing, a retainer having a main body insertable into the insertion opening in the housing and movable to a full locking position for locking the terminal fittings in the cavities, the retainer further comprising a detecting piece located outside the housing, a lock arm formed on the housing in a position substantially opposed to the detecting piece of the retainer, the lock arm being engageable with the mating housing for preventing the two housings from being disengaged from each other, and an escaping portion in a position on the detecting piece of the retainer facing the lock arm in a deforming direction for permitting an elastic deformation of the lock arm only when the retainer substantially reaches the full locking position.

2. A connector according to claim 1, wherein the retainer is insertable into the housing in a direction intersecting with an inserting direction of the terminal fittings.

3. A connector according to claim 1, wherein the retainer is movable with respect to the housing between a partial locking position where insertion and withdrawal of the terminal fittings into and from the cavities are permitted and the full locking position.

4. A connector according to claim 1, wherein the retainer further comprises a holding piece which is provided substantially at an opposite side of the main body from the detecting piece and located outside the housing.

5. A connector according to claim 4, wherein the detecting piece and the holding piece are provided with a locking portion for engaging the housing to prevent the entire retainer from coming out of the housing.

6. A connector according to claim 1, wherein the escaping portion comprises a slanted portion slanted towards the housing with an angle of inclination substantially corresponding to a deformation angle of the deformed lock arm.

7. A connector according to claim 6, wherein one of the lock arm and the escaping portion comprise a detecting projection and the other of the lock arm and the escaping portion comprises a mating detecting recess, wherein the detecting projection is allowed to be inserted into the detecting recess when the retainer is positioned in the full lock position so as to allow the elastic deflection of the lock arm.

8. A connector, comprising:

a first housing having at least one terminal-receiving cavity, a retainer accommodating portion extending into the first housing and communicating with the respective cavity;

a second housing having a receptacle dimensioned for receiving at least a portion of the first housing, a housing lock formed on the second housing in proximity to the receptacle;

a lock arm cantilevered from the first housing and being configured for locked engagement with the housing lock for locking the first housing in the receptacle, the lock arm being deflectable toward the retainer accommodating portion to enable insertion and removal of the first housing into and out of the receptacle; and a retainer having a main body insertable into the retainer accommodating portion for locking a terminal in the cavity, the retainer having a detecting piece located outside the housing and substantially facing the lock arm, the detecting piece having a recess aligned with the lock arm when the retainer is fully inserted in the retainer accommodating portion, said recess being dimensioned for permitting the deflection of the lock arm, portions of the detecting piece adjacent the recess being configured for preventing sufficient deflection of the lock arm for insertion of the first housing into the receptacle.

* * * * *